United States Patent [19]

Miller

[11] Patent Number: 4,614,240

[45] Date of Patent: Sep. 30, 1986

[54] MULTI-BLADE SOIL HANDLING APPARATUS

[75] Inventor: Maurice E. Miller, Grand Island, Nebr.

[73] Assignee: Milfarm Manufacturing Corporation, Grand Island, Nebr.

[21] Appl. No.: 689,482

[22] Filed: Jan. 7, 1985

[51] Int. Cl.[4] ..... A01B 3/62

[52] U.S. Cl. ..... 172/799.5; 172/328

[58] Field of Search ..... 172/799.5, 780, 327, 172/328, 787, 200, 779, 253, 136, 251, 784, 785, 4.5

[56] References Cited

U.S. PATENT DOCUMENTS

| | | | |
|---|---|---|---|
| 1,833,878 | 11/1931 | Adams | 172/327 X |
| 2,186,658 | 1/1940 | Scheunemann | 172/799.5 |
| 2,739,396 | 3/1956 | Frenzel | 172/327 |
| 2,840,971 | 7/1958 | Greeson | 172/328 |
| 2,866,281 | 12/1958 | Breaux | 172/780 |
| 3,809,165 | 5/1974 | Miller | 172/328 |
| 4,047,574 | 9/1977 | Foreman | 172/200 |

FOREIGN PATENT DOCUMENTS

| | | | |
|---|---|---|---|
| 780863 | 8/1957 | United Kingdom | 172/251 |

*Primary Examiner*—Richard J. Johnson

*Attorney, Agent, or Firm*—Zarley, McKee, Thomte, Voorhees & Sease

[57] ABSTRACT

A multi-blade soil handling unit comprising a frame having rearward and forward ends with a pivotal hitch mounted on the forward end of the frame for connection to a prime mover. A transversely extending axle is mounted on the frame and is provided with a pair of ground engaging wheels on opposite ends thereof. A front blade is mounted on the frame forwardly of the wheels and a rear blade is mounted on the frame rearwardly of the ground engaging wheels. A second hydraulic cylinder is connected to the axle and the hitch to pivot the hitch with respect to the frame to permit the selective shifting of weight between the front and rear blades. The blades are normally disposed at opposing angles and are each individually angularly adjusted with respect to the frame and are each laterally adjustable with respect to the frame. The ends of each of the blades may also be raised or lowered by means of shims.

5 Claims, 6 Drawing Figures

MULTI-BLADE SOIL HANDLING APPARATUS

BACKGROUND OF THE INVENTION

Conventional soil handling units or graders normally consist of a self-propelled engine-powered wheeled frame means. The graders normally have an angularly disposed single blade which may be angled, raised or lowered to achieve the desired soil handling or grading effect. The conventional single blade graders can develop a bouncing action in rough or rippled road conditions, with this action causing the blade to impart a further continuing rough pattern to the road surface until the machine is nearly stopped and the action brought under control, the primary remedy being to operate at greatly reduced speeds. The conventional single blade graders have limited abilities to cut and fill road pot holes and low areas with any soil firming action. The conventional single blade graders virtually always leave a ridge of soil in the center of the road if they are being used to maintain a desirable crown to the road and have no ability in a single operation to remove this ridge from the road center, which is dangerous to road traffic and can throw vehicles out of control. The only remedy to this situation being a subsequent operation to move this ridge to the side of the road or into the ditch. This causes the soil which may contain gravel or road aggregate to be lost from use and becomes a primary factor in gradually tearing down the height and profile of the road that was originally built at considerable expense.

Therefore, it is a principal object of the invention to provide a multi-blade soil handling unit.

A further object of the invention is to provide a multi-blade soil handling unit which may be used for soil shaving, cutting and filling with either right or left soil flow from the machine.

Yet another object of the invention is to provide a multi-blade soil handling unit wherein blades are positioned ahead and behind cutting depth control wheels at opposing cutting angles to achieve a stabilizing effect on rough roads or surfaces at both slow and high operating speeds.

Still another object of the invention is to provide a multi-blade soil handling unit wherein the front and rear blades may be offset with respect to each other.

Still another object of the invention is to provide a multi-blade soil handling unit with front to rear hydraulic leveling control so that the ratio of soil handing from the front to rear blade may be varied in any desired amount.

Still another object of the invention is to provide a multi-blade soil handling unit wherein each of the blades have positive, adjustable control of the cutting angle independent of each other which allows the predominate soil flow to be to the left, to the right or balanced.

Still another object of the invention is to provide a multi-blade soil handling unit wherein the machine can be set to operate so that any ridge deposited by the front blade can be caught and completely leveled out by the rear blade in every operation. By operating the unit with a slight side-tilt on the rear blade in the opposite direction of the right-side-down tilt of the front blade, the rear blade will provide distribution of soil and gravel cut by the blades to the surface of the road where they are needed without leaving soil ridges on either side of the unit.

Still another object of the invention is to provide a multi-blade soil handling unit with a superior road smoothing action that is much lower in cost and operation than conventional self-propelled road graders and can be used behind a wide range of readily available medium horsepower tractors.

Still another object of the invention is to provide a multi-blade soil handling unit with snow handling capabilities wherein the blade offset can be reversed so that each blade unloads to the outside for use in snow plowing and snow handling operations up to several inches in snow depth, using the hydraulic leveling to adjust the amount of snow being handled by the front and rear blades.

Still another object of the invention is to provide a multi-blade soil handling unit wherein either end of the blades may be adjustably moved up or down.

These and other objects will be apparent to those skilled in the art.

SUMMARY OF THE INVENTION

Figure 1:
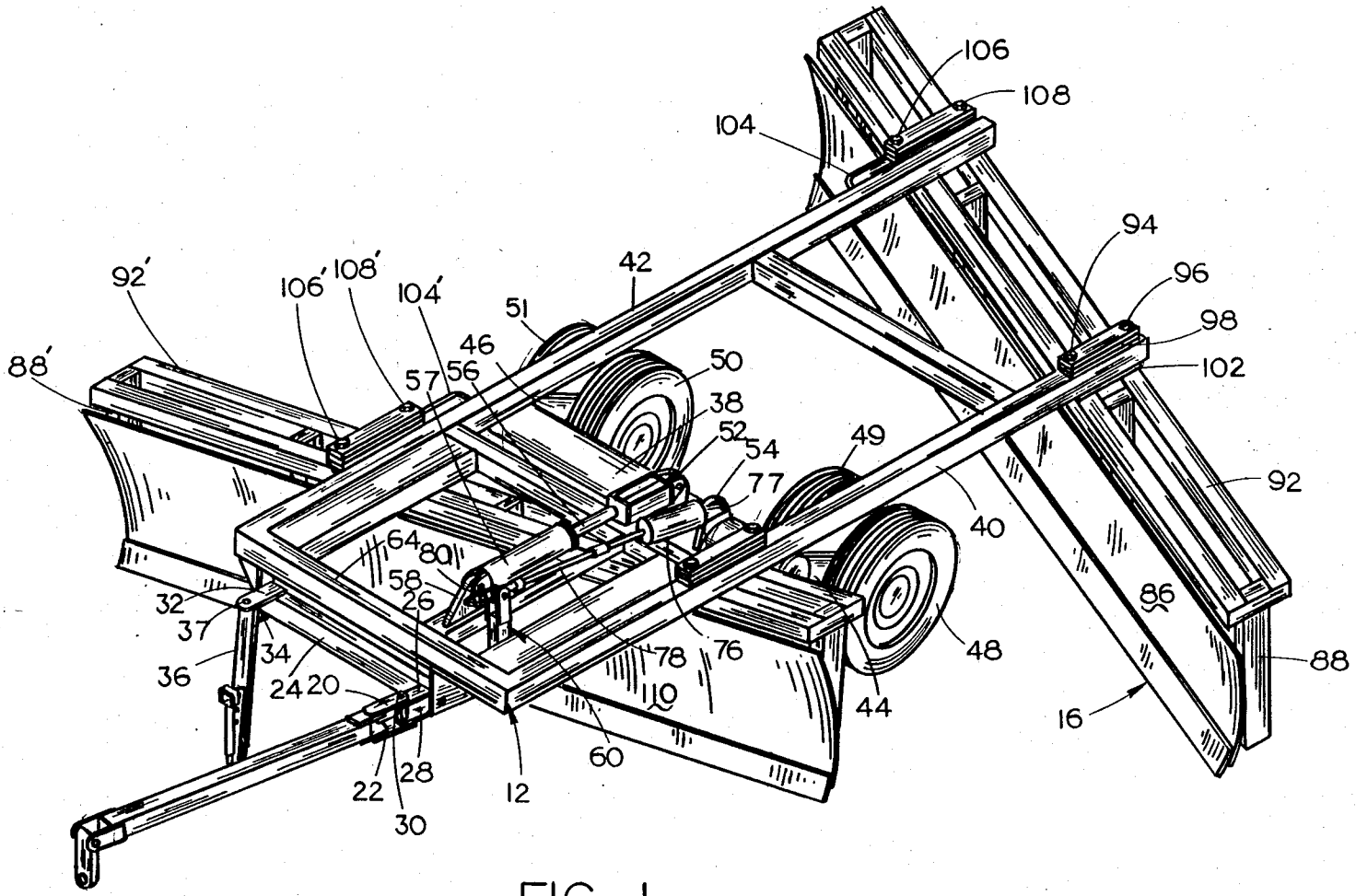
FIG. 1 is a front perspective view of the soil handling unit of this invention.
Figure 2:
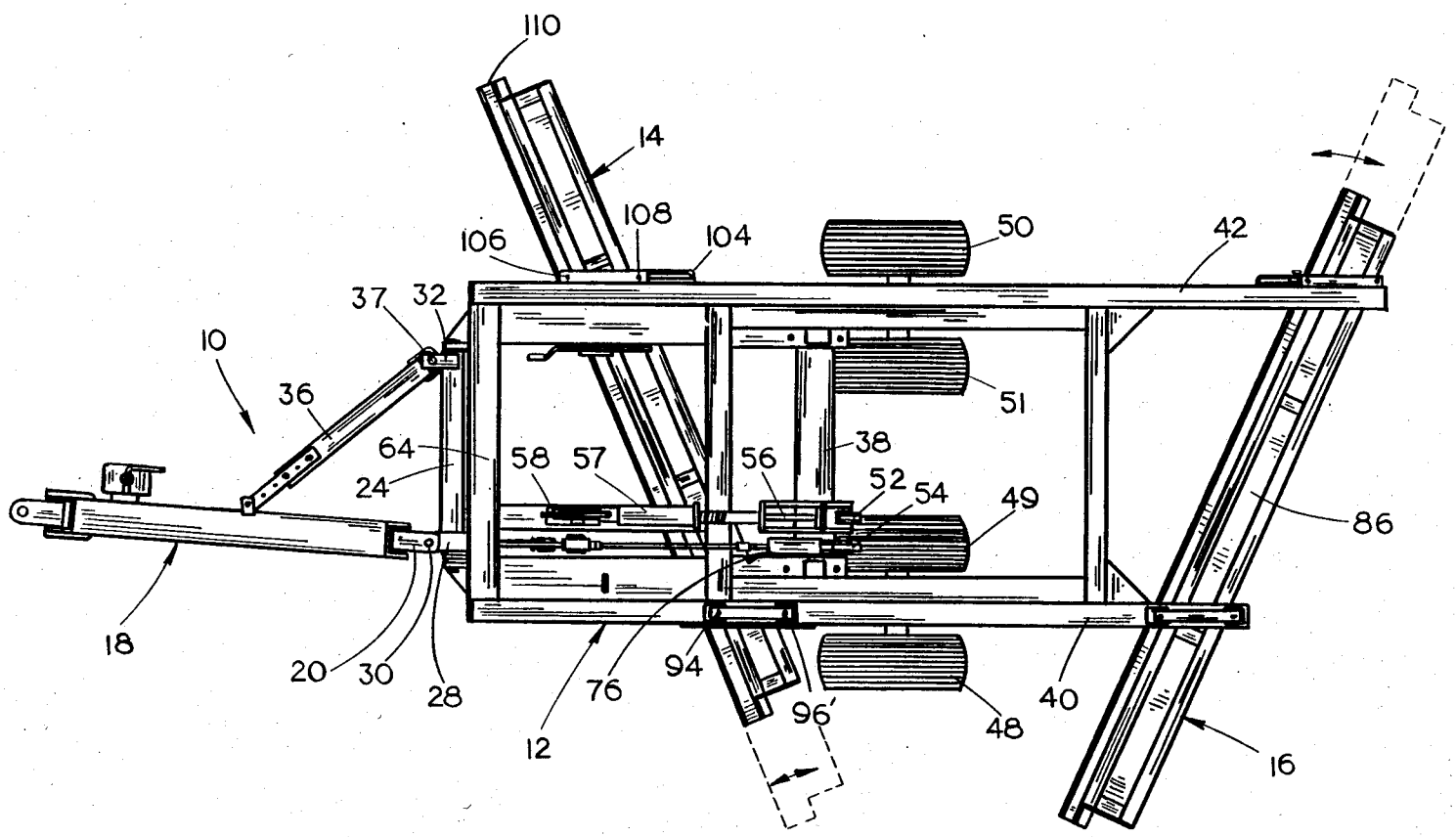
FIG. 2 is a top view of the soil handling unit of this invention.
Figure 3:
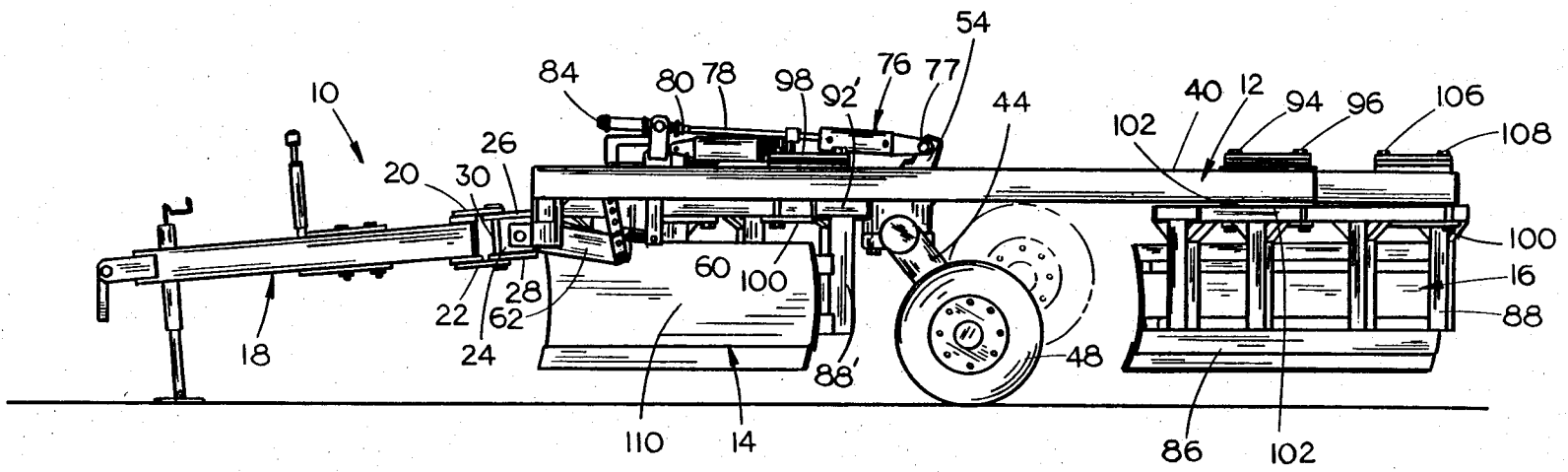
FIG. 3 is a side view of the soil handling unit.
Figure 4:
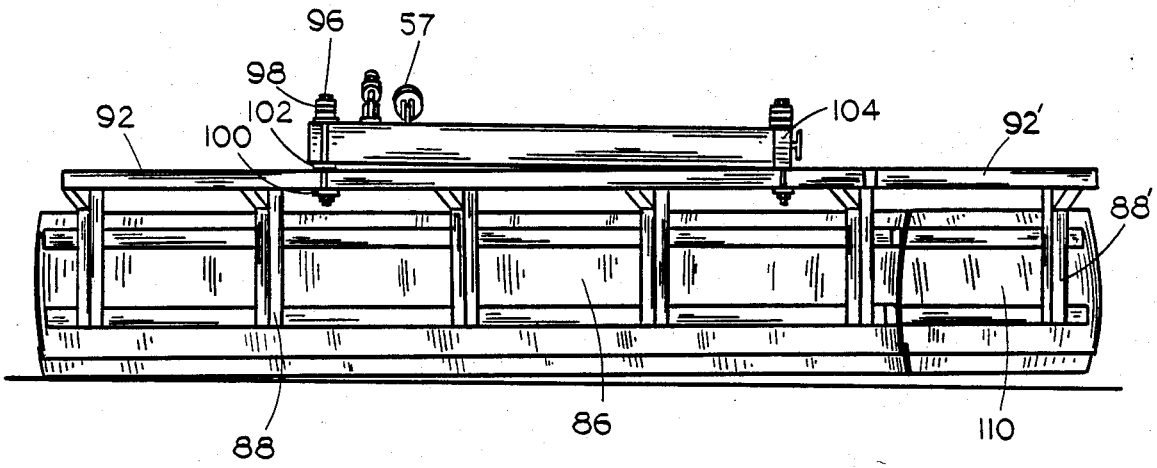
FIG. 4 is a rear view of the soil handling unit.
Figure 5:
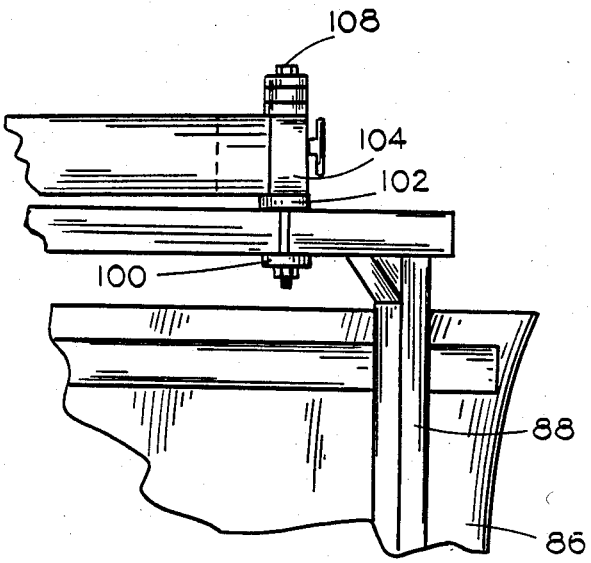
FIG. 5 is a partial rear view of the unit.

The multi-blade soil handling unit of this invention comprises a frame means having rearward and forward ends with the forward end of the frame means having a forwardly extending hitch pivotally secured thereto about a horizontal axis. A transversely extending axle is secured to the frame means and has a pair of ground engaging wheels at the opposite ends thereof. The axle may be selectively rotated with respect to the frame means by means of a first hydraulic cylinder extending between the frame means and the axle means so that the wheels may be raised and lowered with respect to the frame means. A front blade section is secured to the frame means forwardly of the axle and a rear blade section is secured to the frame means rearwardly of the axle. A second hydraulic cylinder is connected to the axle and the hitch to pivot the hitch with respect to the frame means to permit the selective shifting of weight between the blade sections. Each of the blade sections may be selectively angled with respect to the frame means and may be laterally adjusted with respect to the frame means. Further, each of the ends of each of the blades may be lowered with respect to the other end thereof by means of shims.

DESCRIPTION OF THE PREFERRED EMBODIMENT

The numeral 10 refers generally to the blade apparatus of this invention comprising generally a frame means 12 having front and rear blade assemblies 14 and 16 secured thereto in the manner illustrated in the drawings. Although the drawings show the blade assemblies 14 and 16 to be disposed at opposing angles with respect to the direction of travel of the apparatus, the blade assemblies may be disposed in a substantially parallel relationship if needed should the apparatus be used for blading snow or the like from a roadway.

A hitch means 18 is provided at the forward end of the apparatus and has a pair of spaced-apart ears 20 and 22 provided thereon at its rearward end. The numeral 24 refers to a square tubular frame member which is pivoted at its opposite ends about a horizontal axis to the forward end of frame means 12. Frame member 24 has a pair of spaced-apart ears 26 and 28 extending forwardly from one end thereof which are pivotally connected to the ears 20 and 22 by bolt 30. Likewise, a pair of spaced-apart ears 32 and 34 are secured to the other end of the frame member 24 and have a brace 36 pivotally secured thereto by a suitable bolt 37. The forward end of brace 36 is connected to the hitch means 18 intermediate the ends thereof as seen in FIG. 1.

A tubular axle 38 is rotatably mounted to and extends between frame members 40 and 42 of frame means 12. A pair of downwardly extending arms 44 and 46 are secured to the opposite ends of the axle and have spaced-apart wheels 48, 49 and 50, 51 rotatably mounted at the lower ends thereof respectively. A pair of upstanding posts 52 and 54 are secured to the axle so that rotational movement of the axle 38 will cause movement of the posts 52 and 54 and vice versa. The cylinder rod 56 of hydraulic cylinder 57 is pivotally connected to the upper end of post 52. The forward end of cylinder 57 is pivotally connected to the upstanding lug 58 mounted on frame means 12. Extension and retraction of the rod 56 with respect to cylinder 57 causes the pivotal movement of the axle and arms 44 and 46 with respect to the frame means so that the blade assemblies may be raised and lowered to control the depth of the blades and for transport purposes.

The numeral 60 refers to a rocker arm assembly, for hitch leveling, which includes a rocker arm 61 which is pivotally secured to frame 12 via pin 61*a*. The lower free end of rocker arm 61 is pivotally connected to a hitch extension 62 through a link 63. Hitch extension 62 is rigidly affixed to, and extends rearwardly from, frame member 24.

A hydraulic cylinder 76 is pivotally connected at one end to the upper end of post 54 by pin 77. Hydraulic cylinder 76 has an elongated cylinder rod 78 extending forwardly therefrom as seen in the drawing. Collar 80 is rigidly mounted on the rod 78 and is pivotally connected to the upper end of rocker arm assembly 60. Nut 84 is provided on the forward end of the rod 78.

Figure 6:
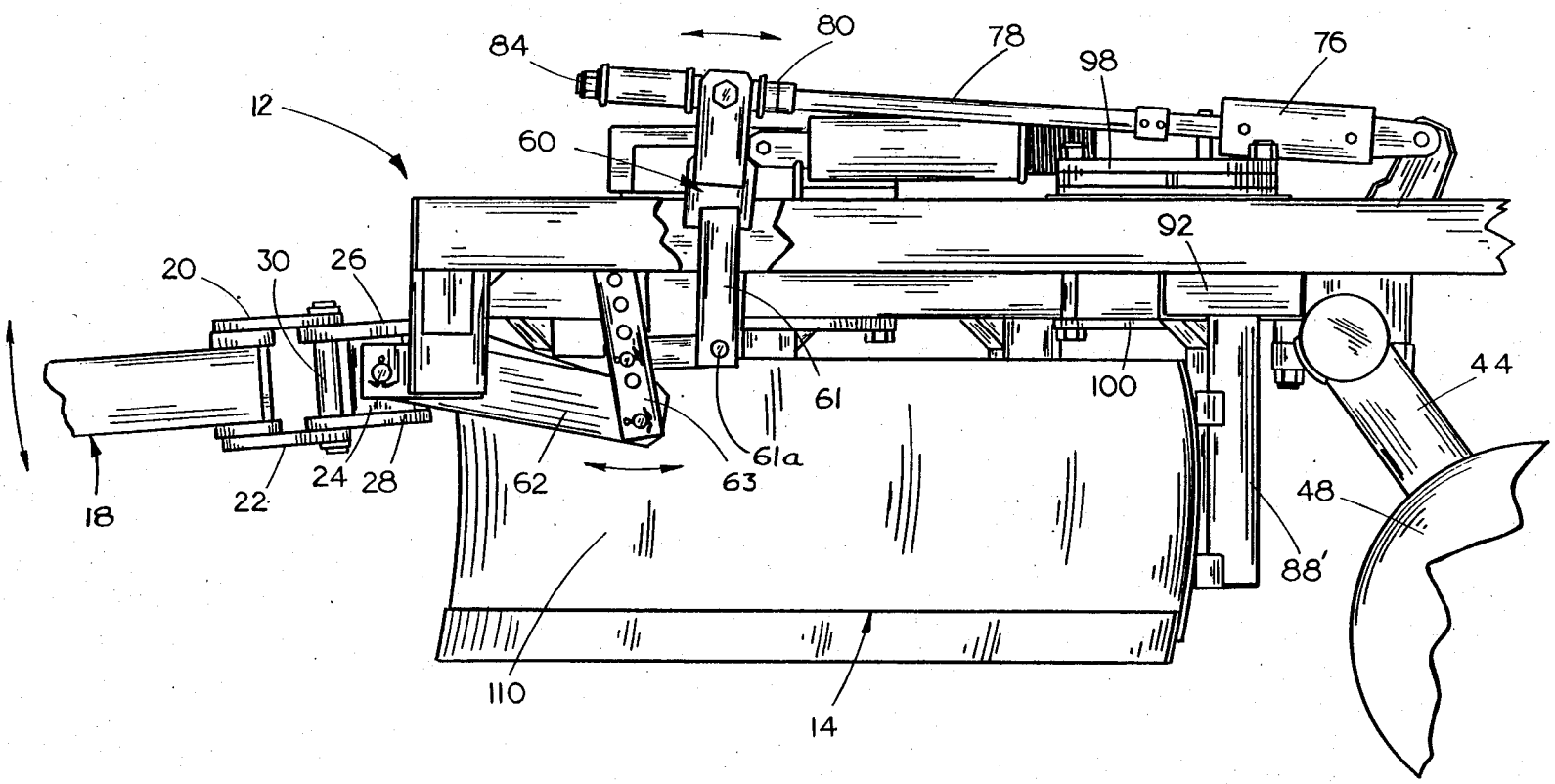
FIG. 6 is a partial side view of the unit.

The hydraulic cylinder 57 extending between the bar 52 and lug 58 is provided only to control blade depth and transport height. The hydraulic cylinder 76 is provided to permit the selective shifting of weight between the front and rear blade assemblies. Retraction of the rod 78 into the cylinder 76 causes the rocker arm assembly 60 to pivot in a clockwise manner, as viewed in FIG. 6, causing the free end of hitch extension 62 to raise, thereby urging the forward end of the hitch means 18 to lower which causes the forward end of the frame means 12 to be raised. The lowering of the forward end of the hitch means 18 and the raising of the forward end of frame means 12 causes additional weight to be exerted on the rear blade section and less weight to be exerted on the front blade section. Conversely, extension of the rod 78 from the cylinder 76 causes the rocker arm assembly 60 to pivot in a counter clockwise manner, as viewed in FIG. 6, causing the free end of hitch extension 62 to lower, thereby causing the forward end of the hitch means 18 to move upwardly and to cause the forward end of frame means 12 to be lowered. The upward movement of the forward end of the hitch means and the lowering of the forward end of frame means 12 causes additional weight to be exerted on the front blade section and less weight to be exerted on the rear blade section. Raising or lowering of the hitch as outlined above causes the weight of the machine to shift to the back or front blade sections of the apparatus with the wheel area being the primary balance point. The tractor operator can remotely control the weight control apparatus from the tractor so that the proper amount of weight can be applied to either the front or rear blade sections. A more detailed description of the weight control feature is found in U.S. Pat. No. 3,809,165 and reliance on that disclosure is made herein.

Blade assembly includes an elongated blade 86 having a plurality of posts 88 secured to the rearward side thereof. Horizontally disposed frame member 92 is secured to the upper ends of the posts 88 and extends therebetween. A pair of bolts 94 and 96 extend downwardly through shims 98 and through the frame member 40 forwardly and rearwardly of the frame member 92. Bolts 94 and 96 extend through plate 100 which is positioned beneath the frame member 92 to maintain one end of the frame member 92 on the frame member 40. If desired, one or more spacer bars 102 may be positioned beneath the underside of frame member 40 and the upper surface of frame member 92 so that the outer end of blade 86 may be lowered relative to the other end of the blade. The other end of blade 86 is longitudinally adjustably secured, by means of bolts 106 and 108, to the side mount 104 secured to the side of frame member 42. The selective longitudinal connection of the blade 86 with respect to the side mount 104 permits the angle of the blade 86 to be varied. The length of the side mount 104 is preferably designed so that the blade 86 may be disposed transversely to the direction of movement of the apparatus. Blade member 110 of front blade assembly 14 is also similarly secured to the frame members 40 and 42 to permit the blade member 110 to be disposed at the angle as illustrated in the drawings such that it is normally at an opposing angle to that of the rear blade. Inasmuch as the structure of front blade 110, and the mounting thereof, is identical to rear blade 86, only rear blade 86 is described in detail with "′" indicating identical structure on front blade 110.

Each of the blades of the front and rear blade assemblies may be moved laterally with respect to the frame means by loosening the bolts 94, 96, 106 and 108 and then moving frame member 92 relative to frame members 40 and 42. The angles of the blades also being selectively varied to achieve the desired blading effect. As previously stated, the spacer bars 102 may be placed between either end of the blade and the frame members 40 and 42 to vary the digging depth of the outer ends of the blades.

In operation, the hitch means 18 is connected to a prime mover such as a tractor or the like and the hydraulic cylinders on the soil handling unit are connected to the hydraulic system of the tractor. The unit 10 may be transported from one location to another by operating hydraulic cylinder 57 so that rod 56 is extended thereby causing the wheels 48, 49, 50 and 51 to be lowered relative to the frame means 12 to raise the blades relative to the ground. When it is desired to grade a road surface or the like, hydraulic cylinder 57 is retracted to raise the wheels 48, 49, 50 and 51 until the lower ends of the blades 86 and 110 are lowered into ground engagement. The relative movement of the wheels 48, 49, 50 and 51 will depend upon the particular depth of grading action desired. Preferably, the blades 86 and 110 are set at the opposing angles as illustrated in FIG. 1. Each of the blades 86 and 110 may be laterally adjusted with respect to the frame means 12 so that the desired soil handling is achieved. The blades may be set behind each other or offset sideways in varying amounts so that when the front blade throws a surplus ridge of soil to the left, the rear blade can be set to catch all of the spillage and feather it out in any amount for complete leveling control. The fact that the unit has one blade ahead and one blade behind the cutting depth control wheels 48, 49, 50 and 51 provides a stabilizing effect on rough roads or surfaces at both slower and higher operating speeds. Due to the fact that this unit not only has the stabilizing effect of two blades with the control wheels but also the construction places the blades at opposing angles, it is impossible for the rear blade to track any cutting pattern of the front blade. As previously stated, the shims 102 may be employed between the frame members 40 and 42 and the frame members 92 and 92' to provide control for additional soil cutting action on either side of a given blade. The unit of this invention has full time front-to-rear hydraulic leveling control through the cylinder 76 so that the ratio of soil handling from the front-to-rear blade can be varied in any desired amount. Placing more cutting on one blade versus the other blade does not place a sideways control problem on the unit as long as the other blade has ground contact. Retraction and extension of the cylinder 76 causes more or less weight to be placed on the blades 86 and 110 as previously described. The two-directional flow of soil from the unit provides double the available soil handling and filling capability of a single blade for leveling potholes or low areas. This additional filling capability with its inherent soil firming action causes the soil leveling job performance of this unit to be superior by creating a soil condition that has more firmness, which is a more durable surface with a longer usage life between leveling operations than that which can be obtained with a soil removing unit utilizing only a single blade.

The use of dual control wheels on each side of the unit provides extra wheel control capabilities to avoid the possibility of a single wheel dropping into a hole. The blades 86 and 110 may be reverse-offset so that each blade unloads to the outside as desired for use in snow clearing or snow plowing in moderate conditions.

Thus it can be seen that the multi-blade soil handling unit of this invention accomplishes at least all of its stated objectives.

I claim:

1. A blade unit, comprising, a longitudinally extending frame means having rearward and forward ends and transverse sides, a transversely extending axle means operatively secured to said frame means and having ground engaging wheels at the opposite ends thereof a front blade section operably secured to transverse sides of said frame means forwardly of said axle means, and adapted to move material from one side of said frame to the other, a rear blade section operably secured to transverse sides of said frame means rearwardly of said axle means, and adapted to move material from one side of said frame to the other, a first hydraulic cylinder means operatively connected to and extending between said frame means and said axle means for raising and lowering said wheels with respect to said frame means, a forwardly extending hitch means operatively secured to said frame means at the forward end thereof, said hitch means being pivotally secured to said frame means about a horizontal axis, a second hydraulic cylinder means operatively connected to and extending between said axle means and said hitch means to pivot said hitch means with respect to said frame means in response to raising or lowering of said frame and to permit the selective shifting of weight between said blade sections.

2. The blade unit of claim 1 wherein each of said front and rear blade sections are selectively laterally adjustably mounted on said frame means.

3. The blade unit of claim 1 wherein each of said front and rear blade sections are selectively angularly mounted on said frame means.

4. The blade unit of claim 3 wherein said blade units are normally positioned on said frame means so as to be at opposing angles relative to each other.

5. The blade unit of claim 1 wherein adjustable mounting means is provided between each of said front and rear blade sections and said frame means so that the outer ends of said blade sections may be raised or lowered relative to said frame means and relative to the other end of said respective blade sections.

* * * * *